US009601827B2

(12) United States Patent
Yamamoto et al.

(10) Patent No.: US 9,601,827 B2
(45) Date of Patent: Mar. 21, 2017

(54) ARRAY-FED REFLECTOR ANTENNA DEVICE AND METHOD OF CONTROLLING THIS DEVICE

(71) Applicant: Mitsubishi Electric Corporation, Tokyo (JP)

(72) Inventors: Shinichi Yamamoto, Tokyo (JP); Yoshio Inasawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 269 days.

(21) Appl. No.: 14/400,333

(22) PCT Filed: Mar. 14, 2013

(86) PCT No.: PCT/JP2013/057222
§ 371 (c)(1),
(2) Date: Nov. 10, 2014

(87) PCT Pub. No.: WO2014/073222
PCT Pub. Date: May 15, 2014

(65) Prior Publication Data

US 2015/0138018 A1 May 21, 2015

(30) Foreign Application Priority Data

Nov. 7, 2012 (JP) ..... 2012-245516

(51) Int. Cl.
*H01Q 3/16* (2006.01)
*H01Q 3/18* (2006.01)
(Continued)

(52) U.S. Cl.
CPC ..... *H01Q 3/16* (2013.01); *H01Q 3/02* (2013.01); *H01Q 3/18* (2013.01); *H01Q 3/20* (2013.01);
(Continued)

(58) Field of Classification Search
USPC ..... 342/81, 154, 372–374, 755, 761, 839
See application file for complete search history.

(56) References Cited

U.S. PATENT DOCUMENTS 4,236,161 A 11/1980 Ohm
4,274,098 A 6/1981 Renau et al.
(Continued)

FOREIGN PATENT DOCUMENTS

EP 0897201 A1 2/1999
EP 0915529 A1 5/1999
(Continued)

OTHER PUBLICATIONS

International Search Report; PCT/JP2013/057222; Jun. 18, 2013.
(Continued)

*Primary Examiner* — Dao Phan
(74) *Attorney, Agent, or Firm* — Studebaker & Brackett PC

(57) ABSTRACT

Beam direction controlling unit includes a relative position determining unit that determines a relative position between a reflector antenna and an array antenna by controlling a driver, e.g., driving unit, a drive controlling unit, such that a range on the array antenna onto which a parallel light beam from a desired beam direction is projected is a range in which element antennas are arranged, an excitation element selector that selects, as element antennas to be excited, element antennas onto which the parallel light beam is projected at the determined relative position, an excitation amplitude phase determining unit that sets an excitation amplitude phase of the selected element antennas, and sets the excitation amplitude phase to an excitation amplitude phase controller, e.g., an amplitude controller, a phase shifter, and an excitation amplitude phase controlling unit,
(Continued)

and a transmitter/receiver connecting unit that connects the selected element antennas to a transmitter/receiver.

21 Claims, 8 Drawing Sheets

(51) Int. Cl.

| | |
|---|---|
| ***H01Q 3/20*** | (2006.01) |
| ***H01Q 3/34*** | (2006.01) |
| ***H01Q 19/12*** | (2006.01) |
| ***H01Q 19/17*** | (2006.01) |
| ***H01Q 3/02*** | (2006.01) |
| ***H01Q 21/22*** | (2006.01) |
| ***H01Q 25/00*** | (2006.01) |

(52) U.S. Cl.
CPC ..... *H01Q 3/34* (2013.01); *H01Q 19/12* (2013.01); *H01Q 19/17* (2013.01); *H01Q 21/22* (2013.01); *H01Q 25/007* (2013.01)

(56) References Cited

U.S. PATENT DOCUMENTS

| | | | |
|---|---|---|---|
| 4,965,588 | A | 10/1990 | Lenormand et al. |
| 6,392,611 | B1 | 5/2002 | Smith et al. |
| 6,441,794 | B1 | 8/2002 | Tang et al. |
| 2009/0262037 | A1 | 10/2009 | Matyas et al. |

FOREIGN PATENT DOCUMENTS

| | | | |
|---|---|---|---|
| JP | S62-098803 | A | 5/1987 |
| JP | H01-276803 | A | 11/1989 |
| JP | H06-334432 | A | 12/1994 |
| JP | H07-046034 | A | 2/1995 |
| JP | 2002-124818 | A | 4/2002 |
| JP | 2002-141845 | A | 5/2002 |
| JP | 2009-200704 | A | 9/2009 |

OTHER PUBLICATIONS

The extended European search report issued by the European Patent Office on Jun. 2, 2016, which corresponds to European Patent Application No. 13852574.6-1811 and is related to U.S. Appl. No. 14/400,333.

ARRAY-FED REFLECTOR ANTENNA DEVICE AND METHOD OF CONTROLLING THIS DEVICE

FIELD OF THE INVENTION

The present invention relates to an array-fed reflector antenna device that is a combination of a reflector antenna and an array antenna used as a primary radiator of the reflector antenna, and that reduces the number of elements included in the array antenna without limiting a beam scanning zone, and a method of controlling the array-fed reflector antenna device.

BACKGROUND OF THE INVENTION

In an array-fed reflector antenna device that is a combination of a reflecting antenna and an array antenna, it is necessary to set an appropriate excitation amplitude and an appropriate phase for each of element antennas which construct the array antenna in order to provide a beam in a desired direction. Conventionally, an excitation phase or excitation amplitude phase for all the element antennas is determined numerically so as to form a beam in a desired direction. Further, a method of determining an excitation amplitude phase efficiently by limiting the range of element antennas to be excited is also disclosed (for example, refer to patent reference 1).

RELATED ART DOCUMENT

Patent Reference

Patent reference 1: Japanese Unexamined Patent Application Publication No. 2009-200704

SUMMARY OF THE INVENTION

Problems to be Solved by the Invention

An array-fed reflector antenna device has a correspondence between a beam orientation and the positions of element antennas. According to the method disclosed by patent reference 1, the range of element antennas at the time of forming a beam in a specific direction is specified, and an excitation amplitude phase is determined. More specifically, it is necessary to place the element antennas in such a way that they correspond to beams respectively in order to scan a beam over a wide range. A problem is therefore that in order to scan a beam over a wide range, it is necessary to increase the range of the array antenna, and hence the number of elements increases.

The present invention is made in order to solve the above-mentioned problem, and it is therefore an object of the present invention to provide an array-fed reflector antenna device that can reduce the number of elements without limiting the beam scanning zone, and a method of controlling the array-fed reflector antenna device.

Means for Solving the Problem

In accordance with the present invention, there is provided an array-fed reflector antenna device including: a reflector antenna; an array antenna that is comprised of element antennas which are arranged in a two-dimensional array as a primary radiator of the reflector antenna; an excitation amplitude phase controller that is connected to each of the element antennas and adjusts an excitation amplitude phase of each of the element antennas; a driver that changes a relative positional relationship between the reflector antenna and the array antenna; and a beam direction controller that controls a beam direction of the reflector antenna by controlling the excitation amplitude phase controller and the driver, in which the beam direction controller includes: a relative position determinator that determines a relative position between the reflector antenna and the array antenna by controlling the driver in such a way that a range on the array antenna onto which a light beam from a desired beam direction is reflected by the reflector antenna and is then projected is a range in which the element antennas are arranged; an excitation element selector that selects, as element antennas to be excited, the element antennas onto which the light beam is projected at the relative position between the reflector antenna and the array antenna which is determined by the relative position determinator; an excitation amplitude phase determinator that determines an excitation amplitude phase value of the element antennas selected by the excitation element selector and sets the excitation amplitude phase value to the excitation amplitude phase controller; and a transmitter receiver connector that connects the element antennas selected by the excitation element selector to a transmitter receiver.

Further, in accordance with the present invention, there is provided an array-fed reflector antenna device including: a reflector antenna that is comprised of a concave surface; a subreflector antenna that is comprised of a convex surface placed at a position opposite to the reflector antenna; an array antenna that is comprised of element antennas which are arranged in a two-dimensional array as a primary radiator of the subreflector antenna; an excitation amplitude phase controller that is connected to each of the element antennas and adjusts an excitation amplitude phase of each of the element antennas; a driver that changes a relative positional relationship between the reflector antenna and the array antenna; and a beam direction controller that controls a beam direction of the reflector antenna by controlling the excitation amplitude phase controller and the driver, in which the beam direction controller includes: a relative position determinator that determines a relative position between the reflector antenna and the array antenna by controlling the driver in such a way that a range on the array antenna onto which a light beam from a desired beam direction is reflected by the reflector antenna, is reflected by the subreflector antenna, and is then projected is a range in which the element antennas are arranged; an excitation element selector that selects, as element antennas to be excited, the element antennas onto which the light beam is projected at the relative position between the reflector antenna and the array antenna which is determined by the relative position determinator; an excitation amplitude phase determinator that determines an excitation amplitude phase value of the element antennas selected by the excitation element selector and sets the excitation amplitude phase value to the excitation amplitude phase controller; and a transmitter receiver connector that connects the element antennas selected by the excitation element selector to a transmitter receiver.

Further, in accordance with the present invention, there is provided an array-fed reflector antenna device including: a reflector antenna that is comprised of a concave surface; a subreflector antenna that is comprised of a concave surface placed at a position opposite to the reflector antenna; an array antenna that is comprised of element antennas which are arranged in a two-dimensional array as a primary radiator of the subreflector antenna; an excitation amplitude phase controller that is connected to each of the element antennas and adjusts an excitation amplitude phase of each of the element antennas; a driver that changes a relative positional relationship between the reflector antenna and the array antenna; and a beam direction controller that controls a beam direction of the reflector antenna by controlling the excitation amplitude phase controller and the driver, in which the beam direction controller includes: a relative position determinator that determines a relative position between the reflector antenna and the array antenna by controlling the driver in such a way that a range on the array antenna onto which a light beam from a desired beam direction is reflected by the reflector antenna, is reflected by the subreflector antenna, and is then projected is a range in which the element antennas are arranged; an excitation element selector that selects, as element antennas to be excited, the element antennas onto which the light beam is projected at the relative position between the reflector antenna and the array antenna which is determined by the relative position determinator; an excitation amplitude phase determinator that determines an excitation amplitude phase value of the element antennas selected by the excitation element selector and sets the excitation amplitude phase value to the excitation amplitude phase controller; and a transmitter receiver connector that connects the element antennas selected by the excitation element selector to a transmitter receiver.

Further, in accordance with the present invention, there is provided a method of controlling an array-fed reflector antenna device including: a reflector antenna; an array antenna that is comprised of element antennas which are arranged in a two-dimensional array as a primary radiator of the reflector antenna; an excitation amplitude phase controller that is connected to each of the element antennas and adjusts an excitation amplitude phase of each of the element antennas; a driver that changes a relative positional relationship between the reflector antenna and the array antenna; and a beam direction controller that controls a beam direction of the reflector antenna by controlling the excitation amplitude phase controller and the driver, in which the beam direction controller includes: a relative position determining step of determining a relative position between the reflector antenna and the array antenna by controlling the driver in such a way that a range on the array antenna onto which a light beam from a desired beam direction is reflected by the reflector antenna and is then projected is a range in which the element antennas are arranged; an excitation element selecting step of selecting, as element antennas to be excited, the element antennas onto which the light beam is projected at the relative position between the reflector antenna and the array antenna which is determined in the relative position determining step; an excitation amplitude phase determining step of determining an excitation amplitude phase value of the element antennas selected in the excitation element selecting step and setting the excitation amplitude phase value to the excitation amplitude phase controller; and a transmitter receiver connecting step of connecting the element antennas selected by the excitation element selector to a transmitter receiver.

Further, in accordance with the present invention, there is provided a method of controlling an array-fed reflector antenna device including: a reflector antenna that is comprised of a concave surface; a subreflector antenna that is comprised of a convex surface placed at a position opposite to the reflector antenna; an array antenna that is comprised of element antennas which are arranged in a two-dimensional array as a primary radiator of the subreflector antenna; an excitation amplitude phase controller that is connected to each of the element antennas and adjusts an excitation amplitude phase of each of the element antennas; a driver that changes a relative positional relationship between the reflector antenna and the array antenna; and a beam direction controller that controls a beam direction of the reflector antenna by controlling the excitation amplitude phase controller and the driver, in which the beam direction controller includes: a relative position determining step of determining a relative position between the reflector antenna and the array antenna by controlling the driver in such a way that a range on the array antenna onto which a light beam from a desired beam direction is reflected by the reflector antenna, is reflected by the subreflector antenna, and is then projected is a range in which the element antennas are arranged; an excitation element selecting step of selecting, as element antennas to be excited, the element antennas onto which the light beam is projected at the relative position between the reflector antenna and the array antenna which is determined in the relative position determining step; an excitation amplitude phase determining step of determining an excitation amplitude phase value of the element antennas selected in the excitation element selecting step and setting the excitation amplitude phase value to the excitation amplitude phase controller; and a transmitter receiver connecting step of connecting the element antennas selected by the excitation element selector to a transmitter receiver.

Further, in accordance with the present invention, there is provided a method of controlling an array-fed reflector antenna device including: a reflector antenna that is comprised of a concave surface; a subreflector antenna that is comprised of a concave surface placed at a position opposite to the reflector antenna; an array antenna that is comprised of element antennas which are arranged in a two-dimensional array as a primary radiator of the subreflector antenna; an excitation amplitude phase controller that is connected to each of the element antennas and adjusts an excitation amplitude phase of each of the element antennas; a driver that changes a relative positional relationship between the reflector antenna and the array antenna; and a beam direction controller that controls a beam direction of the reflector antenna by controlling the excitation amplitude phase controller and the driver, in which the beam direction controller includes: a relative position determining step of determining a relative position between the reflector antenna and the array antenna by controlling the driver in such a way that a range on the array antenna onto which a light beam from a desired beam direction is reflected by the reflector antenna, is reflected by the subreflector antenna, and is then projected is a range in which the element antennas are arranged; an excitation element selecting step of selecting, as element antennas to be excited, the element antennas onto which the light beam is projected at the relative position between the reflector antenna and the array antenna which is determined in the relative position determining step; an excitation amplitude phase determining step of determining an excitation amplitude phase value of the element antennas selected in the excitation element selecting step and setting the excitation amplitude phase value to the excitation amplitude phase controller; and a transmitter receiver connecting step of connecting the element antennas selected by the excitation element selector to a transmitter receiver.

Advantages of the Invention

Because the array-fed reflector antenna device in accordance with the present invention is constructed as above, the number of elements can be reduced without limiting the beam scanning zone.

EMBODIMENTS OF THE INVENTION

Hereafter, the preferred embodiments of the present invention will be explained in detail with reference to the drawings.

Embodiment 1

Figure 1:
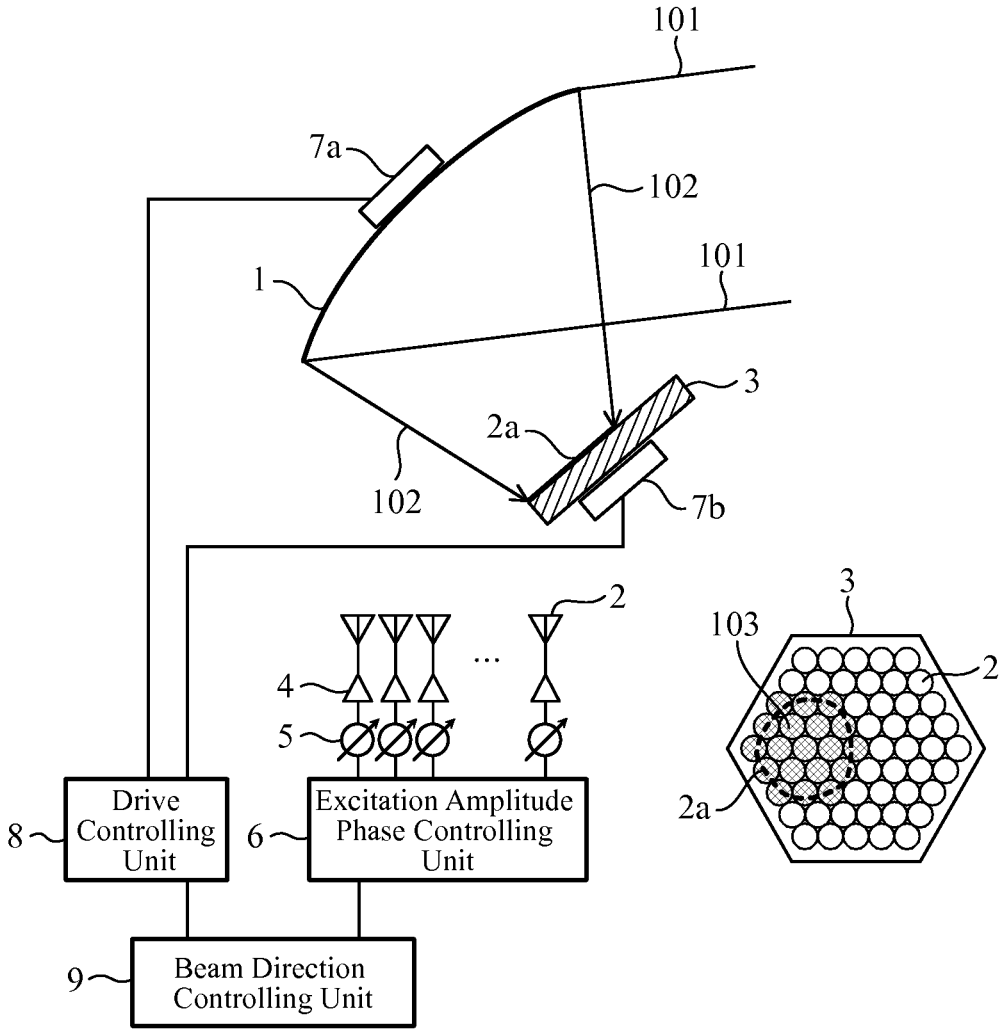
FIG. 1 is a diagram showing the structure of an array-fed reflector antenna device in accordance with Embodiment 1 of the present invention.

FIG. 1 is a diagram showing the structure of an array-fed reflector antenna device in accordance with Embodiment 1 of the present invention.

The array-fed reflector antenna device is comprised of a reflector antenna 1, an array antenna 3 that is comprised of element antennas 2 arranged in a two-dimensional array as a primary radiator of the reflector antenna 1, an amplitude controller 4, a phase shifter 5, an excitation amplitude phase controlling unit 6, a driving unit 7, a drive controlling unit 8, and a beam direction controlling unit (beam direction controller) 9, as shown in FIG. 1.

Although the element antennas 2 and the array antenna 3 are shown at different locations in order to make the diagram legible in FIG. 1, the element antennas 2 are actually disposed in the array antenna 3.

The reflector antenna 1 is comprised of a concave surface, and reflects a light beam emitted from the array antenna 3 to emit this light beam into space and also reflects a light beam from the space and emits this light beam to the array antenna 3.

The array antenna 3 converts a signal from a transmitter receiver (not shown) into a light beam and emits this light beam to the reflector antenna 1, and also receives a light beam from the reflector antenna 1 and outputs this light beam to the transmitter receiver.

The amplitude controller 4 is connected to each of the element antennas 2, and adjusts the excitation amplitude of each of the element antennas 2 according to a control by the excitation amplitude phase controlling unit 6. The amplitude controller 4 can be an attenuator or an amplifier.

The phase shifter 5 is connected to each of the element antennas 2, and adjusts the excitation phase of each of the element antennas 2 according to a control by the excitation amplitude phase controlling unit 6.

The excitation amplitude phase controlling unit 6 controls the amplitude controller 4 and the phase shifter 5 according to a control by the beam direction controlling unit 9.

The amplitude controller 4, the phase shifter 5, and the excitation amplitude phase controlling unit 6 correspond to an excitation amplitude phase controller in accordance with the present invention.

The driving unit 7 changes a relative positional relationship between the reflector antenna 1 and the array antenna 3 according to a control by the drive controlling unit 8. In the example shown in FIG. 1, a case in which a driving unit 7*a* that can change the orientation of the reflector antenna 1 and a driving unit 7*b* that can change the position of the array antenna 3 are disposed as the driving unit 7 is shown.

The drive controlling unit 8 controls the driving unit 7 according to a control by the beam direction controlling unit 9.

The driving unit 7 and the drive controlling unit 8 correspond to a driver in accordance with the present invention.

Figure 2:
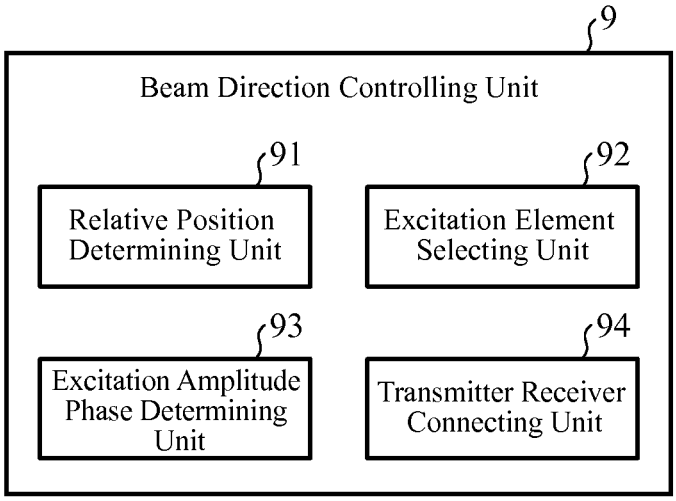
FIG. 2 is a diagram showing the structure of a beam direction controlling unit in accordance with Embodiment 1 of the present invention.

The beam direction controlling unit 9 controls the beam direction of the reflector antenna 1 by controlling the drive controlling unit 8 and the excitation amplitude phase controlling unit 6. This beam direction controlling unit 9 is comprised of a relative position determining unit (relative position determinator) 91, an excitation element selecting unit (excitation element selector) 92, an excitation amplitude phase determining unit (excitation amplitude phase determinator) 93, and a transmitter receiver connecting unit (transmitter receiver connector) 94, as shown in FIG. 2.

The relative position determining unit 91 determines the relative positional relationship between the reflector antenna 1 and the array antenna 3 by controlling the drive controlling unit 8. In this case, the reflector antenna 1 and/or the array antenna 3 is driven mechanically in such a way that a range on the surface of the array antenna 3 onto which a parallel light beam 101 from a desired beam direction is reflected by the outline of the mirror surface of the reflector antenna 1 and is then projected is a range in which element antennas 2 are arranged.

The excitation element selecting unit 92 selects, as element antennas 2 to be excited, the element antennas 2 onto which the above-mentioned parallel light beam 101 is projected at the relative position between the reflector antenna 1 and the array antenna 3, which is determined by the relative position determining unit 91.

The excitation amplitude phase determining unit 93 determines an excitation amplitude phase for the element antennas 2 selected by the excitation element selecting unit 92, and sets the excitation amplitude phase for the excitation amplitude phase controlling unit 6. In this case, the excitation amplitude phase determining unit determines the excitation amplitude phase in such a way that a gain in the desired beam direction is maximized.

The transmitter receiver connecting unit 94 connects the element antennas 2 selected by the excitation element selecting unit 92 to the transmitter receiver by using a switch or the like.

Next, a method of controlling the array-fed reflector antenna device constructed as above will be explained with reference to FIG. 3.

Figure 3:
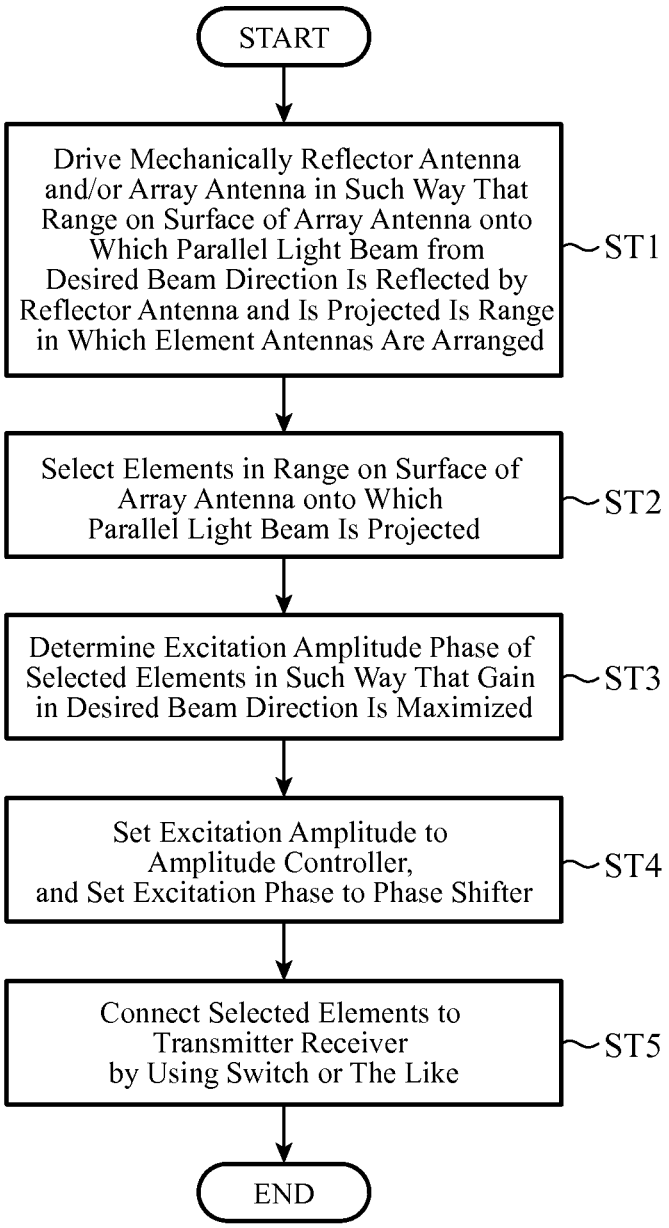
FIG. 3 is a flow chart showing a method of controlling the array-fed reflector antenna device in accordance with Embodiment 1 of the present invention.

In this method of controlling the array-fed reflector antenna device, the relative position determining unit 91 controls the drive controlling unit 8 first to determine the relative positional relationship between the reflector antenna 1 and the array antenna 3 (step ST1, relative phase determining step), as shown in FIG. 3. In this case, the reflector antenna 1 and/or the array antenna 3 is driven mechanically in such a way that the range on the surface of the array antenna 3 onto which the parallel light beam 101 from the desired beam direction is reflected by the outline of the mirror surface of the reflector antenna 1 and is then projected is a range in which element antennas 2 are arranged.

In this case, as a method of driving the reflector antenna 1 and/or the array antenna 3, either a translation or rotation within a surface or both of them can be carried out.

The provision of this step ST1 can extend the beam scanning zone as compared with that of an array-fed reflector antenna device in which a reflector antenna 1 and an array antenna 3 are fixed mechanically. Further, because the range on the surface of the array antenna 3 onto which the parallel light beam 101 is projected can be moved by mechanically moving the relative position between the reflector antenna 1 and the array antenna 3, beam scanning can be carried out over a wide range even if the range of arrangement of the element antennas 2 of the array antenna 3 is the same. Further, when the beam scanning zone is the same, the range in which the element antennas 2 are arranged can be reduced.

In a conventional array-fed reflector antenna device, because it is necessary to determine the range of the element antennas 2 in such a way that the range corresponds to the beam scanning zone, it is necessary to widen the range in which the element antennas 2 are arranged when the beam scanning zone is wide, and hence the number of elements increases. In contrast, in the antenna configuration in accordance with the present invention, by dividing the beam scanning zone and dividing the beam scanning into beam scanning according to an excitation distribution and beam scanning according to mechanical driving, the range in which the element antennas 2 are arranged can be limited while the beam scanning zone is maintained. It can also be considered that beam scanning can be carried out over a wide range with the structure of the array-fed reflector antenna device having a narrow beam scanning zone.

Then, the excitation element selecting unit 92 selects, as the element antennas 2 to be excited, the element antennas 2 onto which the parallel light beam 101 is projected at the relative position between the reflector antenna 1 and the array antenna 3, which is determined by the relative position determining unit 91 (step ST2, excitation element selecting step).

For example, in the example of FIG. 1, the parallel light beam 101 is reflected by the outline of the mirror surface of the reflector antenna 1 and turns into a light beam 102, and the element antennas 2*a* included in a range 103 in which the light beam 102 crosses the surface of the array antenna 3 are selected as the element antennas 2 to be excited.

In this case, because the parallel light beam 101 is reflected toward a direction determined by only the law of reflection and does not include any wave effect, the element antennas 2 to be excited can be selected in a very short time.

Then, the excitation amplitude phase determining unit 93 determines an excitation amplitude phase for the element antennas 2 selected by the excitation element selecting unit 92, and sets the excitation amplitude phase for the excitation amplitude phase controlling unit 6 (step ST3, excitation amplitude phase determining step). At this time, the excitation amplitude phase determining unit determines the excitation amplitude phase in such a way that the gain in the desired beam direction is maximized.

In this case, because an excitation amplitude phase only to the element antennas 2 in the limited range is determined in accordance with the present invention as compared with a method of determining an excitation amplitude phase for all the element antennas, like a conventional method, an excitation amplitude phase for a beam in the desired direction can be determined in a short time.

The excitation amplitude phase controlling unit 6 then sets the excitation amplitude of the amplitude control device 4 and the excitation phase of the phase shifter 5 according to the excitation amplitude phase determined by the excitation amplitude phase determining unit 93 (step ST4). As a result, a beam in the desire direction can be formed.

The transmitter receiver connecting unit 94 then connects the element antennas 2 selected by the excitation element selecting unit 92 to the transmitter receiver by using a switch or the like (step ST5, transmitter receiver connecting step). At this time, all of the element antennas 2 selected by the excitation element selecting unit 92 can be connected. As an alternative, element antennas 2 whose excitation amplitude determined by the excitation amplitude phase determining unit 93 is small can be excluded, so that the number of elements connected can be reduced.

As mentioned above, because the array-fed reflector antenna device in accordance with this Embodiment 1 is constructed in such a way that the reflector antenna 1 and/or the array antenna 3 is driven mechanically in such a way that the range on the surface of the array antenna 3 onto which the parallel light beam 101 from the desired beam direction is reflected by the reflector antenna 1 and is then projected is a range in which element antennas 2 are arranged, the number of elements can be reduced without limiting the beam scanning zone.

Embodiment 2

Although the case in which both the reflector antenna 1 and the array antenna 3 can be driven is shown in Embodiment 1, a case in which only a reflector antenna 1 can be driven and a relative positional relationship with an array antenna 3 is changed is shown in Embodiment 2.

Figure 4:
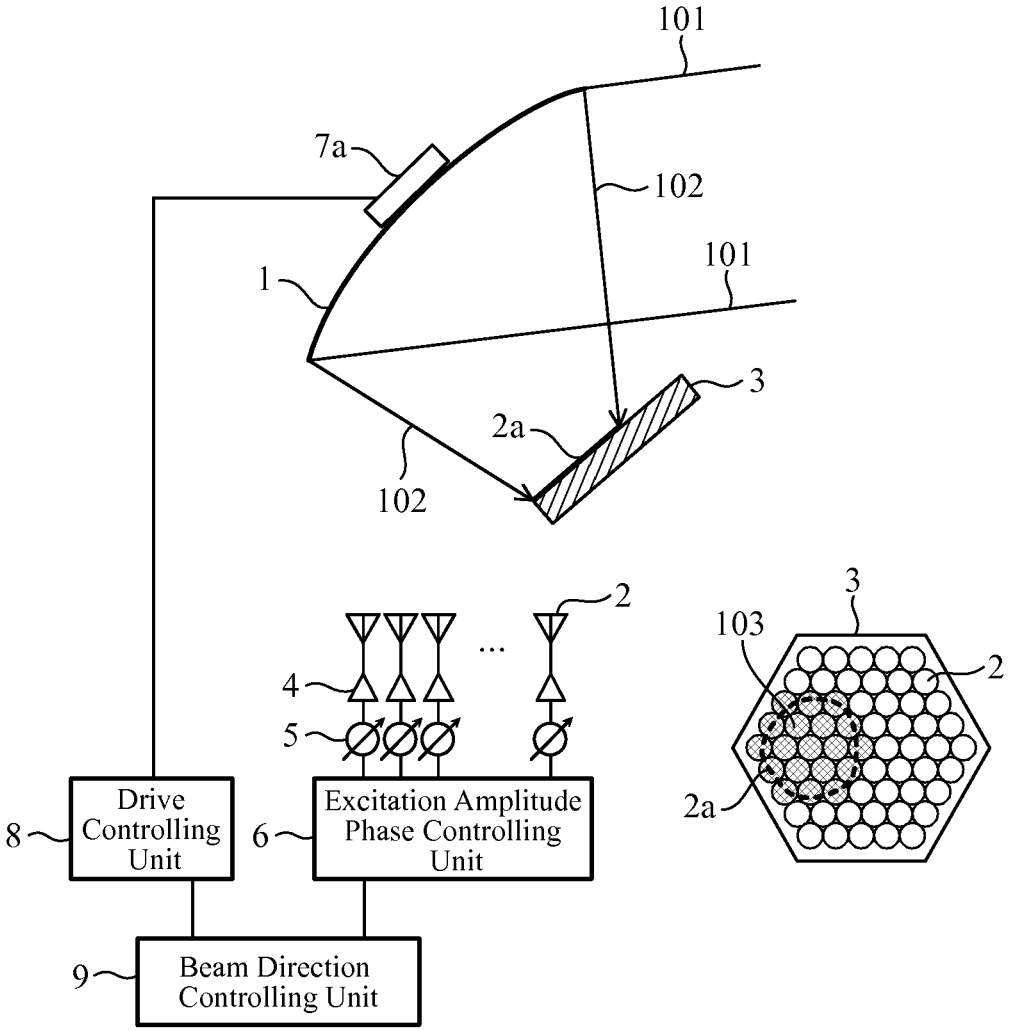
FIG. 4 is a diagram showing the structure of an array-fed reflector antenna device in accordance with Embodiment 2 of the present invention.

FIG. 4 is a diagram showing the structure of an array-fed reflector antenna device in accordance with Embodiment 2 of the present invention. The array-fed reflector antenna device in accordance with Embodiment 2 shown in FIG. 4 is the one in which the driving unit 7*b*, which is disposed on a side of the array antenna 3 of the array-fed reflector antenna device in accordance with Embodiment 1 shown in FIG. 1, is eliminated. The other structural components are the same as those of Embodiment 1 and are denoted by the same reference numerals, and the explanation of the components will be omitted hereafter.

A transmitter receiver is connected to each of element antennas 2 of an array antenna 3, and a high frequency signal is transmitted to each of the element antennas. Further, in a case in which the transmit side has big electric power or low loss property is required, a waveguide may be used as a connection line. In addition, the array antenna 3 may be fixed to a body or vehicle body in which the array antenna is mounted for heat dissipation. In such a case, it is difficult to drive the array antenna 3. In contrast, the reflector antenna 1 can be driven easily. Therefore, in such a case as above, only the reflector antenna 1 is driven. As a driving method, either a translation or rotation within a surface or both of them can be carried out. Further, by driving the reflector antenna 1, the same beam scan characteristic is acquired with about half of the amount of movement as compared with the case of driving the array antenna 3.

As mentioned above, the array-fed reflector antenna device in accordance with this Embodiment 2 can provide the same advantage as that provided by Embodiment 1 even if the array-fed reflector antenna device is constructed in such away as to drive only the reflector antenna 1.

Embodiment 3

Although the case in which both the reflector antenna 1 and the array antenna 3 can be driven is shown in Embodiment 1, a case in which only an array antenna 3 can be driven and a relative positional relationship with a reflector antenna 1 is changed is shown in Embodiment 3.

Figure 5:
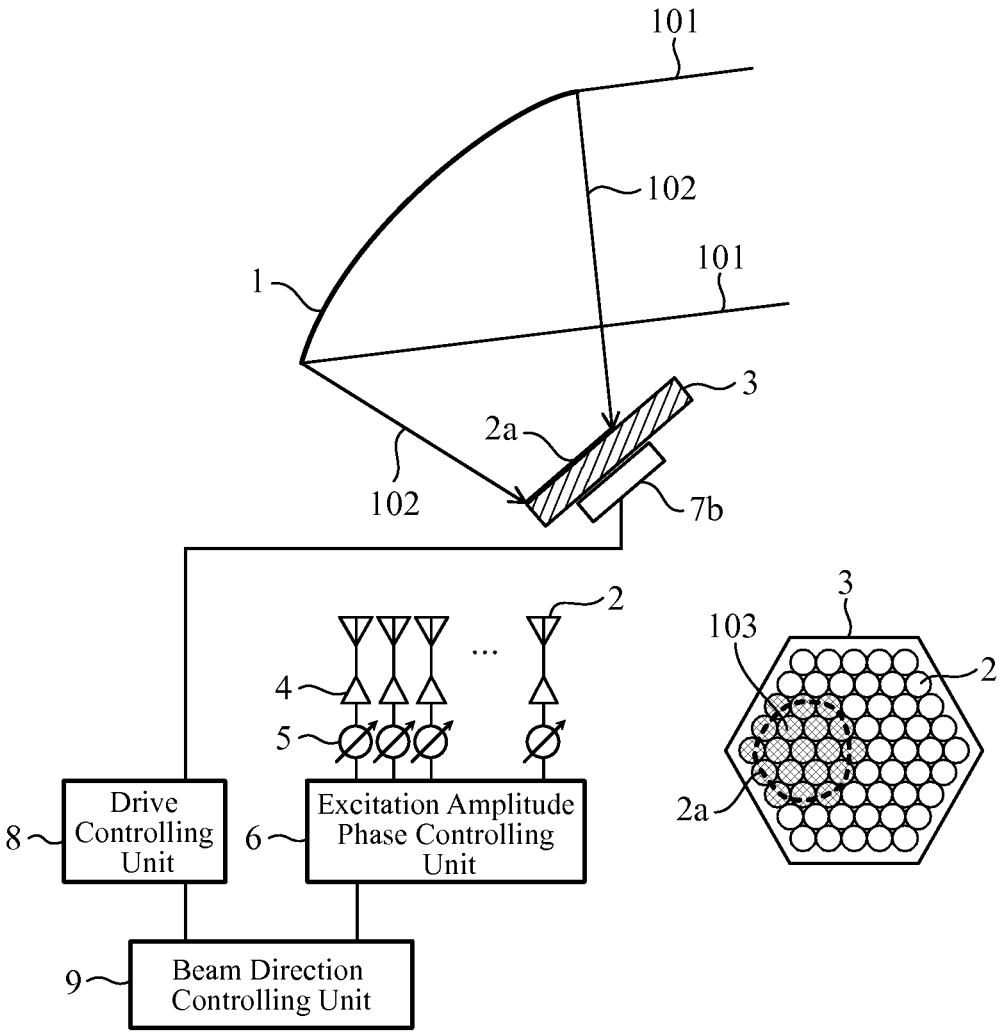
FIG. 5 is a diagram showing the structure of an array-fed reflector antenna device in accordance with Embodiment 3 of the present invention.

FIG. 5 is a diagram showing the structure of an array-fed reflector antenna device in accordance with Embodiment 3 of the present invention. The array-fed reflector antenna device in accordance with Embodiment 3 shown in FIG. 5 is the one in which the driving unit 7*a*, which is disposed on a side of the reflector antenna 1 of the array-fed reflector antenna device in accordance with Embodiment 1 shown in FIG. 1, is eliminated. The other structural components are the same as those of Embodiment 1 and are denoted by the same reference numerals, and the explanation of the components will be omitted hereafter.

A reflector antenna 1 is typically large compared with an array antenna 3. Therefore, because it may be difficult to drive the reflector antenna 1, only the array antenna 1 is driven. As a driving method, either a translation or rotation within a surface or both of them can be carried out.

As mentioned above, the array-fed reflector antenna device in accordance with this Embodiment 3 can provide the same advantage as that provided by Embodiment 1 even if the array-fed reflector antenna device is constructed in such a way as to drive only the array antenna 3.

Embodiment 4

Figure 6:
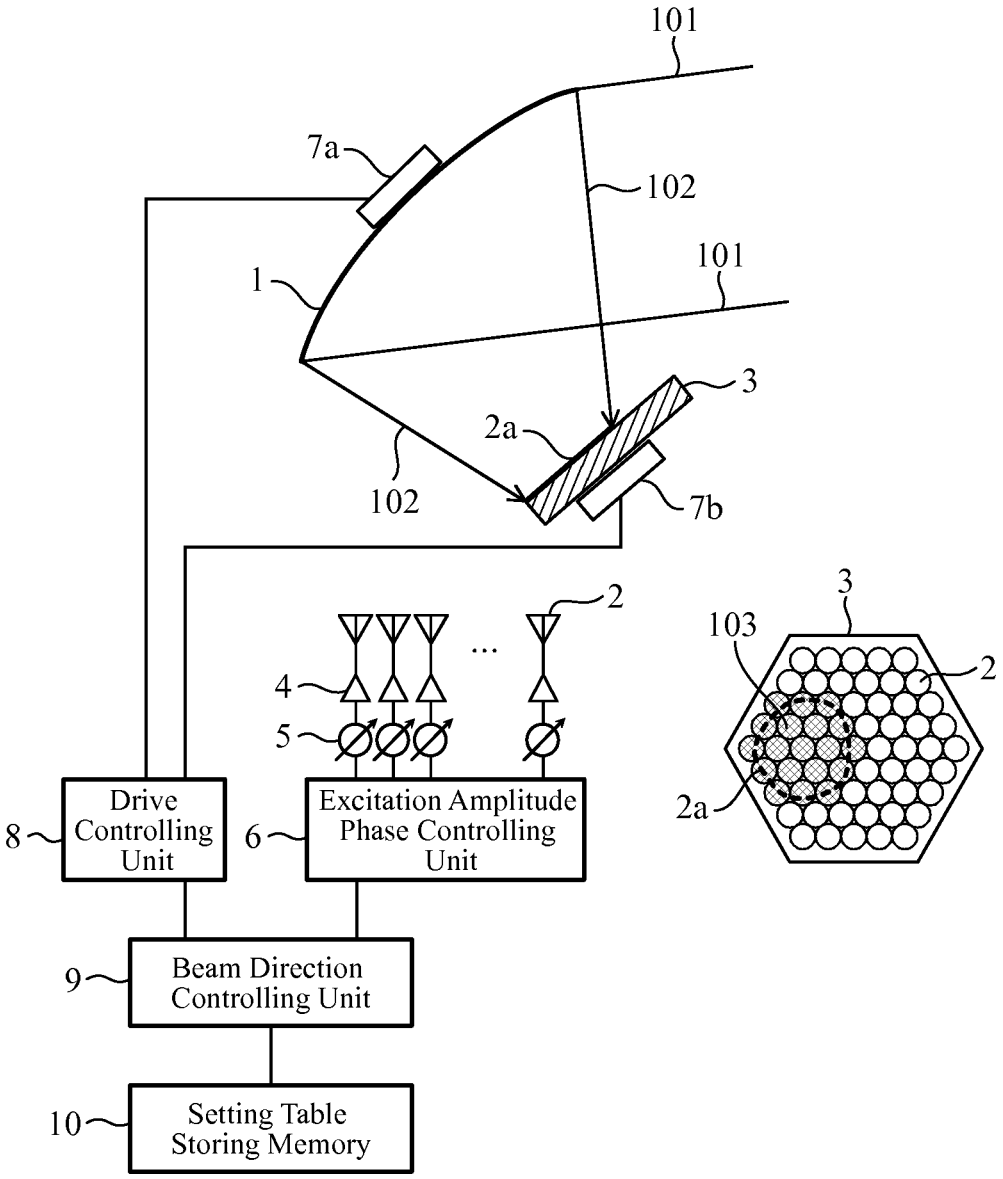
FIG. 6 is a diagram showing the structure of an array-fed reflector antenna device in accordance with Embodiment 4 of the present invention.

FIG. 6 is a diagram showing the structure of an array-fed reflector antenna device in accordance with Embodiment 4 of the present invention. The array-fed reflector antenna device in accordance with Embodiment 4 shown in FIG. 6 is the one in which a setting table storing memory 10 is added to the array-fed reflector antenna device in accordance with Embodiment 1 shown in FIG. 1. The other structural components are the same as those of Embodiment 1 and are denoted by the same reference numerals, and the explanation of the components will be omitted hereafter.

The setting table storing memory 10 holds control values which are setting information about the excitation amplitude phases of a driving unit 7 and an array antenna 3 by a beam direction controlling unit 9 with respect to a predetermined beam direction.

When controlling a drive controlling unit 8 and an excitation amplitude phase controlling unit 6 in order to control the beam direction, the beam direction controlling unit 9 performs the control operation by using the predetermined settings held by the setting table storing memory 10.

As mentioned above, because the array-fed reflector antenna device in accordance with this Embodiment 4 is constructed in such a way as to control the drive controlling unit 8 and the excitation amplitude phase controlling unit 6 by using the control values stored in the setting table storing memory 10, the array-fed reflector antenna device can orient a beam toward a specific direction without performing arithmetic processing, in addition to the advantage provided by Embodiment 1. Therefore, in addition to making it possible to perform high-speed processing, the necessity to mount an arithmetic device can be eliminated.

Embodiment 5

Figure 7:
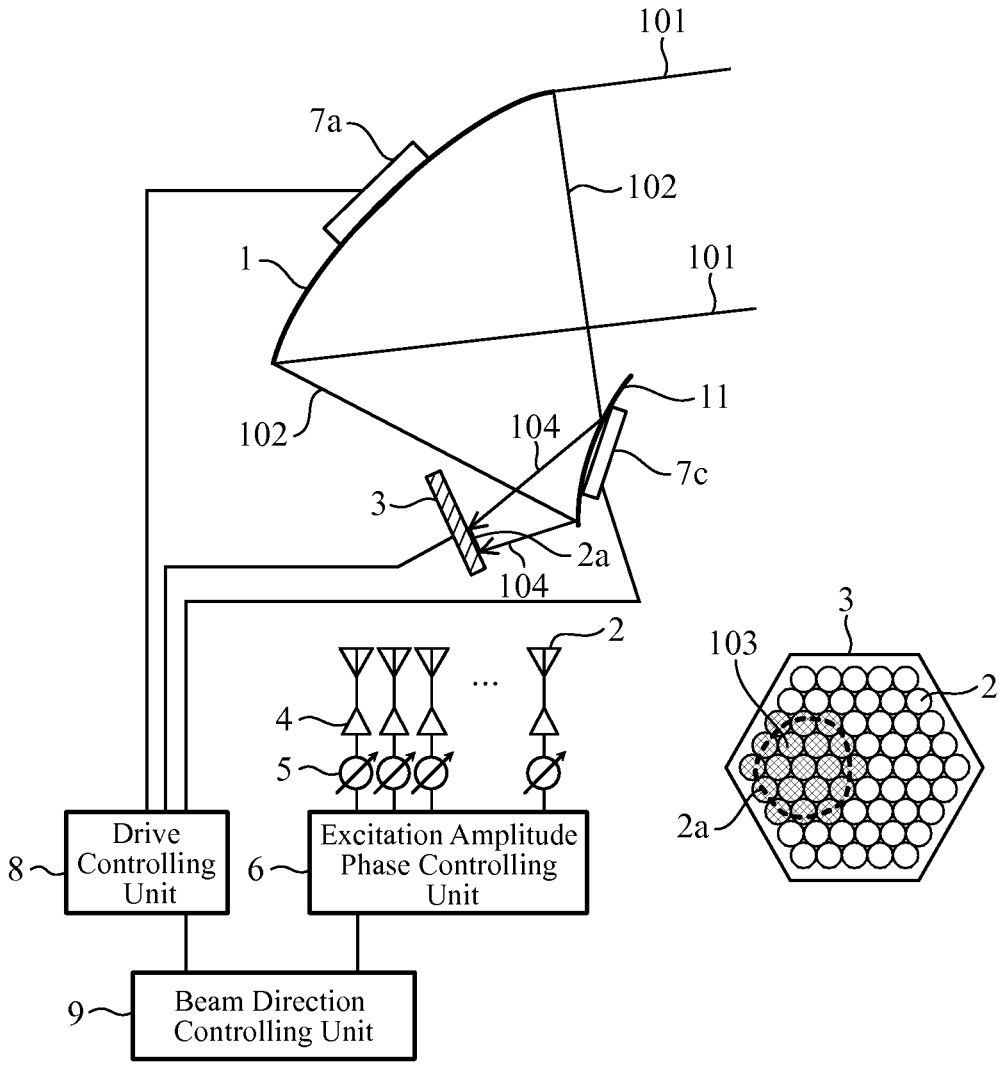
FIG. 7 is a diagram showing the structure of an array-fed reflector antenna device in accordance with Embodiment 5 of the present invention.

FIG. 7 is a diagram showing the structure of an array-fed reflector antenna device in accordance with Embodiment 5 of the present invention. The array-fed reflector antenna device in accordance with Embodiment 5 shown in FIG. 7 is the one in which the driving unit 7*b* of the array-fed reflector antenna device in accordance with Embodiment 1 shown in FIG. 1 is eliminated, and a subreflector antenna 11 that is comprised of a convex surface and a driving unit 7*c* are added between a reflector antenna 1 and an array antenna 3. The other structural components are the same as those of Embodiment 1 and are denoted by the same reference numerals, and the explanation of the components will be omitted hereafter.

The subreflector antenna 11 is comprised of a convex surface, and reflects a light beam emitted from the array antenna 3 and emits this light beam to the reflector antenna 1, and also reflects a light beam from the reflector antenna 1 and emits this light beam to the array antenna 3.

The driving unit 7*c* can change the orientation of the subreflector antenna 11 according to a control by a drive controlling unit 8.

In this case, element antennas 2 are arranged in a two dimensional array as a primary radiator of the subreflector antenna 11.

Because the focal range to the array antenna 3 becomes narrow by inserting the subreflector antenna 11 that is comprised of a convex surface between the reflector antenna 1 and the array antenna 3 this way, the number of elements required for the array antenna 3 can be reduced. Further, by designing the mirror surface system on a cross polarization elimination condition, the cross polarization can be suppressed.

Embodiment 6

Figure 8:
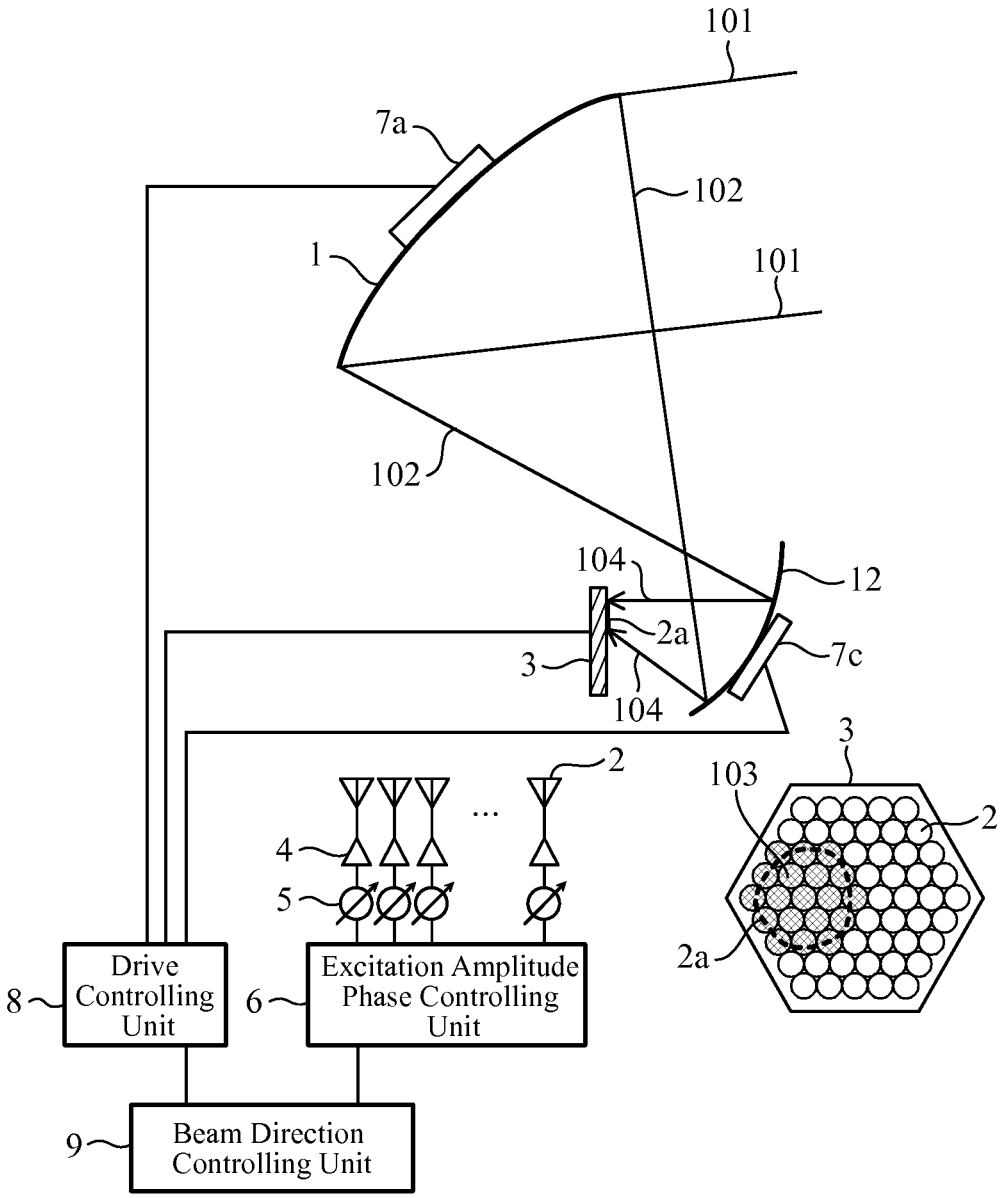
FIG. 8 is a diagram showing the structure of an array-fed reflector antenna device in accordance with Embodiment 6 of the present invention.

FIG. 8 is a diagram showing the structure of an array-fed reflector antenna device in accordance with Embodiment 6 of the present invention. The array-fed reflector antenna device in accordance with Embodiment 6 shown in FIG. 8 is the one in which the driving unit 7*b* of the array-fed reflector antenna device in accordance with Embodiment 1 shown in FIG. 1 is eliminated, and a subreflector antenna 12 that is comprised of a concave surface and a driving unit 7*c* are added between a reflector antenna 1 and an array antenna 3. The other structural components are the same as those of Embodiment 1 and are denoted by the same reference numerals, and the explanation of the components will be omitted hereafter.

The subreflector antenna 12 is comprised of a concave surface, and reflects a light beam emitted from the array antenna 3 and emits this light beam to the reflector antenna 1, and also reflects a light beam from the reflector antenna 1 and emits this light beam to the array antenna 3.

The driving unit 7*c* can change the orientation of the subreflector antenna 11 according to a control by a drive controlling unit 8. In this case, element antennas 2 are arranged in a two dimensional array as a primary radiator of the subreflector antenna 12.

Because the focal range to the array antenna 3 becomes narrow by inserting the subreflector antenna 12 that is comprised of a concave surface between the reflector antenna 1 and the array antenna 3 this way, the number of elements required for the array antenna 3 can be reduced. Further, by designing the mirror surface system on a cross polarization elimination condition, the cross polarization can be suppressed.

While the invention has been described in its preferred embodiments, it is to be understood that an arbitrary combination of two or more of the above-mentioned embodiments can be made, various changes can be made in an arbitrary component in accordance with any one of the above-mentioned embodiments, and an arbitrary component in accordance with any one of the above-mentioned embodiments can be omitted within the scope of the invention.

INDUSTRIAL APPLICABILITY

The array-fed reflector antenna device and the method of controlling the array-fed reflector antenna device in accordance with the present invention can reduce the number of elements without limiting the beam scanning zone, and is suitable for use as an array-fed reflector antenna device that is a combination of a reflector antenna and an array antenna used as a primary radiator of the reflector antenna, and that reduces the number of elements without limiting the beam scanning zone and a method of controlling the array-fed reflector antenna device, and so on.

EXPLANATIONS OF REFERENCE NUMERALS

1 reflector antenna, 2 element antenna, 3 array antenna, 4 amplitude controller, 5 phase shifter, 6 excitation amplitude phase controlling unit, 7, 7*a*, 7*b*, 7*c* driving unit, 8 drive controlling unit, 9 beam direction controlling unit, 10 setting table storing memory, 11, 12 subreflector antenna, 91 relative position determiner, 92 excitation element selector, 93 excitation amplitude phase determiner, 94 transmitter receiver connector, 101 parallel light beam, 102, 104 light beam, 103 range.

The invention claimed is:

1. An array-fed reflector antenna device comprising:

a reflector antenna;

an array antenna that is comprised of element antennas which are arranged in a two-dimensional array as a primary radiator of said reflector antenna;

an excitation amplitude phase controller that is connected to each of said element antennas and adjusts an excitation amplitude phase of said each of said element antennas;

a driver that changes a relative positional relationship between said reflector antenna and said array antenna; and a beam direction controller that controls a beam direction of said reflector antenna by controlling said excitation amplitude phase controller and said driver, wherein said beam direction controller includes: a relative position determinator that determines a relative position between said reflector antenna and said array antenna by controlling said driver in such a way that a range on said array antenna onto which a light beam from a desired beam direction is reflected by said reflector antenna and is then projected is a range in which said element antennas are arranged; an excitation element selector that selects, as element antennas to be excited, said element antennas onto which said light beam is projected at the relative position between said reflector antenna and said array antenna which is determined by said relative position determinator; an excitation amplitude phase determinator that determines an excitation amplitude phase value of the element antennas selected by said excitation element selector and sets the excitation amplitude phase value to said excitation amplitude phase controller; and a transmitter/receiver connector that connects the element antennas selected by said excitation element selector to a transmitter/receiver.

2. An array-fed reflector antenna device comprising:

a reflector antenna that is comprised of a concave surface;

a subreflector antenna that is comprised of a convex surface placed at a position opposite to said reflector antenna;

an array antenna that is comprised of element antennas which are arranged in a two-dimensional array as a primary radiator of said subreflector antenna;

an excitation amplitude phase controller that is connected to each of said element antennas and adjusts an excitation amplitude phase of said each of said element antennas;

a driver that changes a relative positional relationship between said reflector antenna and said array antenna; and a beam direction controller that controls a beam direction of said reflector antenna by controlling said excitation amplitude phase controller and said driver, wherein said beam direction controller includes: a relative position determinator that determines a relative position between said reflector antenna and said array antenna by controlling said driver in such a way that a range on said array antenna onto which a light beam from a desired beam direction is reflected by said reflector antenna, is reflected by said subreflector antenna, and is then projected is a range in which said element antennas are arranged; an excitation element selector that selects, as element antennas to be excited, said element antennas onto which said light beam is projected at the relative position between said reflector antenna and said array antenna which is determined by said relative position determinator; an excitation amplitude phase determinator that determines an excitation amplitude phase value of the element antennas selected by said excitation element selector and sets the excitation amplitude phase value to said excitation amplitude phase controller; and a transmitter/receiver connector that connects the element antennas selected by said excitation element selector to a transmitter/receiver.

3. An array-fed reflector antenna device comprising:

a reflector antenna that is comprised of a concave surface;

a subreflector antenna that is comprised of a concave surface placed at a position opposite to said reflector antenna;

an array antenna that is comprised of element antennas which are arranged in a two-dimensional array as a primary radiator of said subreflector antenna;

an excitation amplitude phase controller that is connected to each of said element antennas and adjusts an excitation amplitude phase of said each of said element antennas;

a driver that changes a relative positional relationship between said reflector antenna and said array antenna; and a beam direction controller that controls a beam direction of said reflector antenna by controlling said excitation amplitude phase controller and said driver, wherein said beam direction controller includes: a relative position determinator that determines a relative position between said reflector antenna and said array antenna by controlling said driver in such a way that a range on said array antenna onto which a light beam from a desired beam direction is reflected by said reflector antenna, is reflected by said subreflector antenna, and is then projected is a range in which said element antennas are arranged; an excitation element selector that selects, as element antennas to be excited, said element antennas onto which said light beam is projected at the relative position between said reflector antenna and said array antenna which is determined by said relative position determinator; an excitation amplitude phase determinator that determines an excitation amplitude phase value of the element antennas selected by said excitation element selector and sets the excitation amplitude phase value to said excitation amplitude phase controller; and a transmitter/receiver connector that connects the element antennas selected by said excitation element selector to a transmitter/receiver.

4. The array-fed reflector antenna device according to claim 1, wherein said relative position determinator changes an orientation of said reflector antenna by controlling said driver.

5. The array-fed reflector antenna device according to claim 2, wherein said relative position determinator changes an orientation of said reflector antenna by controlling said driver.

6. The array-fed reflector antenna device according to claim 3, wherein said relative position determinator changes an orientation of said reflector antenna by controlling said driver.

7. The array-fed reflector antenna device according to claim 1, wherein said relative position determinator changes a position of said array antenna by controlling said driver.

8. The array-fed reflector antenna device according to claim 2, wherein said relative position determinator changes a position of said array antenna by controlling said driver.

9. The array-fed reflector antenna device according to claim 3, wherein said relative position determinator changes a position of said array antenna by controlling said driver.

10. The array-fed reflector antenna device according to claim 1, wherein said array-fed reflector antenna device includes a setting table storing memory that holds a control value for said excitation amplitude phase controller and a control value for said driver with respect to a predetermined beam direction, and said beam direction controller controls said excitation amplitude phase controller and said driver by using the settings held by said setting table storing memory.

11. The array-fed reflector antenna device according to claim 2, wherein said array-fed reflector antenna device includes a setting table storing memory that holds a control value for said excitation amplitude phase controller and a control value for said driver with respect to a predetermined beam direction, and said beam direction controller controls said excitation amplitude phase controller and said driver by using the settings held by said setting table storing memory.

12. The array-fed reflector antenna device according to claim 3, wherein said array-fed reflector antenna device includes a setting table storing memory that holds a control value for said excitation amplitude phase controller and a control value for said driver with respect to a predetermined beam direction, and said beam direction controller controls said excitation amplitude phase controller and said driver by using the settings held by said setting table storing memory.

13. A method of controlling an array-fed reflector antenna device including: a reflector antenna; an array antenna that is comprised of element antennas which are arranged in a two-dimensional array as a primary radiator of said reflector antenna; an excitation amplitude phase controller that is connected to each of said element antennas and adjusts an excitation amplitude phase of said each of said element antennas; a driver that changes a relative positional relationship between said reflector antenna and said array antenna; and a beam direction controller that controls a beam direction of said reflector antenna by controlling said excitation amplitude phase controller and said driver, wherein said beam direction controller includes:

a relative position determining step of determining a relative position between said reflector antenna and said array antenna by controlling said driver in such a way that a range on said array antenna onto which a light beam from a desired beam direction is reflected by said reflector antenna and is then projected is a range in which said element antennas are arranged;

an excitation element selecting step of selecting, as element antennas to be excited, said element antennas onto which said light beam is projected at the relative position between said reflector antenna and said array antenna which is determined in said relative position determining step;

an excitation amplitude phase determining step of determining an excitation amplitude phase value of the element antennas selected in said excitation element selecting step and setting the excitation amplitude phase value to said excitation amplitude phase controller; and a transmitter/receiver connecting step of connecting the element antennas selected by said excitation element selector to a transmitter/receiver.

14. A method of controlling an array-fed reflector antenna device including: a reflector antenna that is comprised of a concave surface; a subreflector antenna that is comprised of a convex surface placed at a position opposite to said reflector antenna; an array antenna that is comprised of element antennas which are arranged in a two-dimensional array as a primary radiator of said subreflector antenna; an excitation amplitude phase controller that is connected to each of said element antennas and adjusts an excitation amplitude phase of said each of said element antennas; a driver that changes a relative positional relationship between said reflector antenna and said array antenna; and a beam direction controller that controls a beam direction of said reflector antenna by controlling said excitation amplitude phase controller and said driver, wherein said beam direction controller includes:

a relative position determining step of determining a relative position between said reflector antenna and said array antenna by controlling said driver in such a way that a range on said array antenna onto which a light beam from a desired beam direction is reflected by said reflector antenna, is reflected by said subreflector antenna, and is then projected is a range in which said element antennas are arranged;

an excitation element selecting step of selecting, as element antennas to be excited, said element antennas onto which said light beam is projected at the relative position between said reflector antenna and said array antenna which is determined in said relative position determining step;

an excitation amplitude phase determining step of determining an excitation amplitude phase value of the element antennas selected in said excitation element selecting step and setting the excitation amplitude phase value to said excitation amplitude phase controller; and a transmitter/receiver connecting step of connecting the element antennas selected by said excitation element selector to a transmitter/receiver.

15. A method of controlling an array-fed reflector antenna device including: a reflector antenna that is comprised of a concave surface; a subreflector antenna that is comprised of a concave surface placed at a position opposite to said reflector antenna; an array antenna that is comprised of element antennas which are arranged in a two-dimensional array as a primary radiator of said subreflector antenna; an excitation amplitude phase controller that is connected to each of said element antennas and adjusts an excitation amplitude phase of said each of said element antennas; a driver that changes a relative positional relationship between said reflector antenna and said array antenna; and a beam direction controller that controls a beam direction of said reflector antenna by controlling said excitation amplitude phase controller and said driver, wherein said beam direction controller includes:

a relative position determining step of determining a relative position between said reflector antenna and said array antenna by controlling said driver in such a way that a range on said array antenna onto which a light beam from a desired beam direction is reflected by said reflector antenna, is reflected by said subreflector antenna, and is then projected is a range in which said element antennas are arranged;

an excitation element selecting step of selecting, as element antennas to be excited, said element antennas onto which said light beam is projected at the relative position between said reflector antenna and said array antenna which is determined in said relative position determining step;

an excitation amplitude phase determining step of determining an excitation amplitude phase value of the element antennas selected in said excitation element selecting step and setting the excitation amplitude phase value to said excitation amplitude phase controller; and a transmitter/receiver connecting step of connecting the element antennas selected by said excitation element selector to a transmitter/receiver.

16. The method of controlling the array-fed reflector antenna device according to claim 13, wherein an orientation of said reflector antenna is changed by controlling said driver in said relative position determining step.

17. The method of controlling the array-fed reflector antenna device according to claim 14, wherein an orientation of said reflector antenna is changed by controlling said driver in said relative position determining step.

18. The method of controlling the array-fed reflector antenna device according to claim 15, wherein an orientation of said reflector antenna is changed by controlling said driver in said relative position determining step.

19. The method of controlling the array-fed reflector antenna device according to claim 13, wherein a position of said array antenna is changed by controlling said driver in said relative position determining step.

20. The method of controlling the array-fed reflector antenna device according to claim 14, wherein a position of said array antenna is changed by controlling said driver in said relative position determining step.

21. The method of controlling the array-fed reflector antenna device according to claim 15, wherein a position of said array antenna is changed by controlling said driver in said relative position determining step.

* * * * *